United States Patent [19]

Ross

[11] Patent Number: 4,524,478

[45] Date of Patent: Jun. 25, 1985

[54] TOOTHBRUSH

[76] Inventor: L. Wayne Ross, 1107 Church St., Bastrop, Tex. 78602

[21] Appl. No.: 505,433

[22] Filed: Jun. 17, 1983

[51] Int. Cl.[3] ..... A46B 9/04

[52] U.S. Cl. ..... 15/106; 15/143 R; 15/167 R; 40/314

[58] Field of Search ..... 15/167 R, 167 A, 106, 15/110, 143 R, DIG. 5; 128/62 A; 40/314

[56] References Cited

U.S. PATENT DOCUMENTS

| | | | |
|---|---|---|---|
| 1,914,240 | 6/1933 | Caldwell . | |
| 2,360,745 | 10/1944 | Vogel | 15/167 R |
| 3,188,673 | 6/1965 | Newman | 15/167 R |
| 4,033,008 | 7/1977 | Warren et al. . | |
| 4,150,457 | 4/1979 | Larson . | |
| 4,185,349 | 7/1980 | Padas . | |

FOREIGN PATENT DOCUMENTS

| | | | |
|---|---|---|---|
| 561300 | 5/1944 | United Kingdom | 15/106 |

*Primary Examiner*—Peter Feldman

[57] ABSTRACT

A toothbrush consisting of two brusheads extending outwardly from a common elongated labeled handle. Brusheads are connected to the handle by means of curved neck portions extending in parallel directions, yet holding bristle arrangements in opposing directions and at opposite and equal angles of forty-five degrees with respect to the longitudinal axis of the handle. Bristle arrangements are specifically constructed to most effectively cover, contact, and clean one-half of each tooth surface area naturally available for toothbrush access. Bristle arrangements consisting of three portions corresponding to three specific areas of one-half of tooth and gumline of user. The opposite one-half of the tooth and gumline being cleaned by using the reverse end of the toothbrush, the identification of which being found on the labeled handle.

3 Claims, 18 Drawing Figures

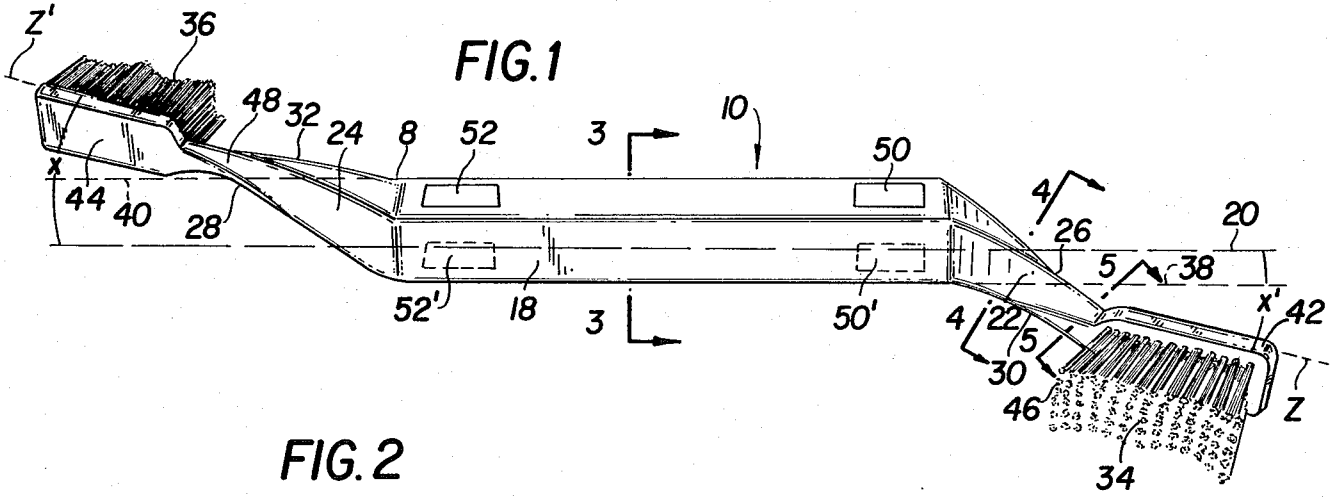
FIG. 1
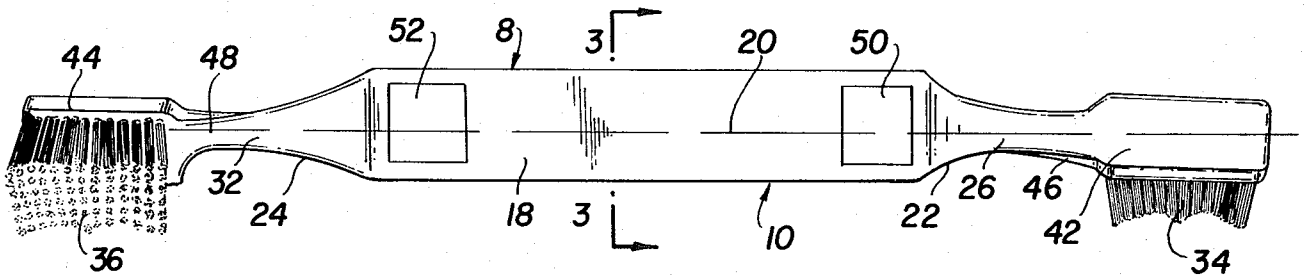
FIG. 2
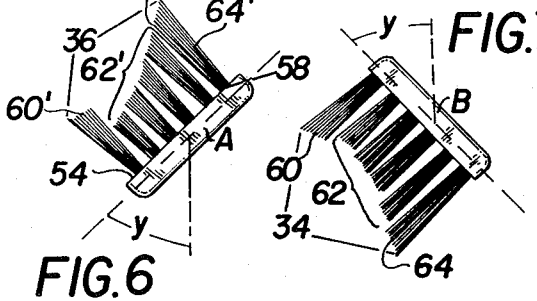
FIG. 7
FIG. 6
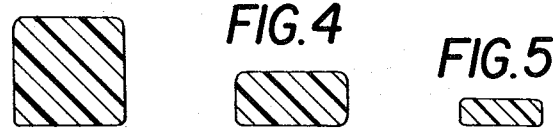
FIG. 5
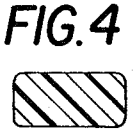
FIG. 4
FIG. 3
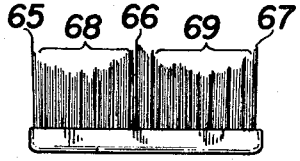
FIG. 8
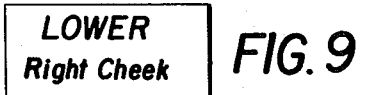
FIG. 9
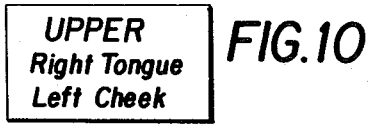
FIG. 10
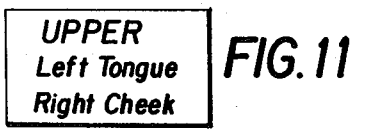
FIG. 11
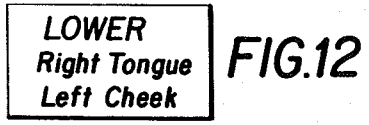
FIG. 12

FIG. 13
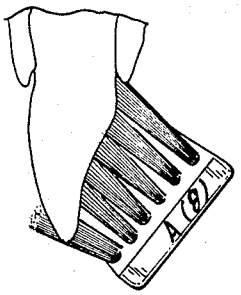
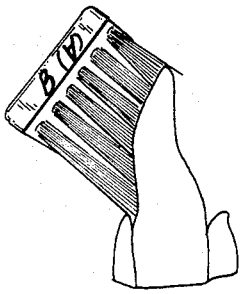
FIG. 14
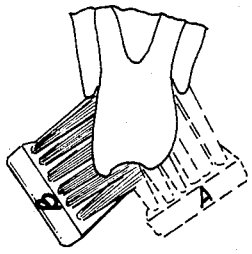
FIG. 15
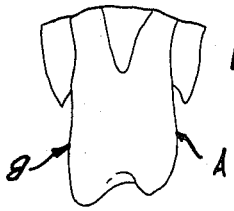
FIG. 16
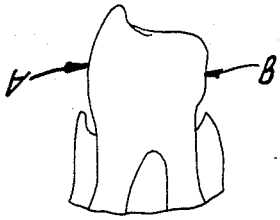
FIG. 17
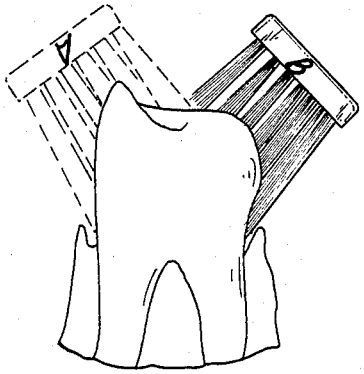
FIG. 18

TOOTHBRUSH

FIELD OF INVENTION

My invention relates to toothbrushes which specifically have a common handle, two brush heads, and specific bristle arrangement for improved oral hygiene.

DISCUSSION OF PRIOR ART

Prior art which are pertinent to consider are included in the following U.S. Pat. Nos.:

| | | |
|---|---|---|
| a. Larson | 4,150,457 | issued 04/24/79 |
| b. Caldwell | 1,914,240 | issued 06/13/33 |
| c. Papas | 4,185,349 | issued 07/29/80 |
| d. Warren, et. al | 4,033,008 | issued 07/05/77 |

It is accepted that the accumulation of plaque on the tooth surfaces and beneath the gumline is primarily responsible for dental cavities and periodontal disease. Various brushing methods and prior art toothbrushes have been proposed, yet dental cavities and periodontal disease are still prevalent.

It is germane to this discussion to observe that every tooth has five surfaces exposed in the oral cavity for plaque accumulation and cleaning access. Any toothbrush, including prior art and my invention, can possibly clean effectively three surfaces: (1) tongue (or inside) surface, (2) biting surface, and (3) outside (cheek or lip) surface. The remaining two surfaces, or proximal surfaces, are accessible for cleaning only with dental floss or tape, as the proximity of the adjacent tooth prevents toothbrush bristle access. Therefore, discussion of improved toothbrush design should concern itself with improved cleansing of the aforementioned three accessible tooth surfaces.

Most plaque accumulation occurs from just below the gumline and up the tongue and cheek sides approximately one-third of the distance to the biting surface. This area, just described, harbors plaque because it is concave and less prominent than tongue and cheek surfaces closer to the biting surface, which are more prominent and convex, and thus naturally cleansed by movement of and contact with tongue, cheek, lip, food, or opposing teeth during chewing motions. The other significant area of plaque accumulation is in the natural grooves, pits, and recesses present in biting surfaces of teeth. Plaque accumulation therefore tends to occur in recessed or concave areas, and is naturally prevented on convex, prominent, smooth surface areas. Plaque accumulation in the grooves and pits in the biting surfaces of teeth can result in cavities. Plaque accumulation adjacent to gum lines can result in cavities and/or the initiation of the progressive, chronic periodontal disease process. Daily removal of plaque is the foundation of dental disease prevention.

Prior art brushes with two heads attached to a common handle attempted to provide easier access to the aforementioned three accessible tooth surfaces by altering the angle of the brushead to the handle or to the opposite brushead, and by various handle and head shape designs.

Larson preferred a grooved, straight common handle with two circular heads containing bristles pointing essentially the same direction from the handle. One head was intended for the concave lingual surfaces of the upper and lower front teeth, the other head for the remaining teeth. The bristle design was generally convex. The large heads would be difficult to manipulate in crowded and overlapped segments of the human dentition, and would tend to initiate the gag reflex when used on lingual surfaces of upper and lower back teeth. The grooves in the common handle would accumulate moisture, dirt, and perspiration and become unsanitary in use. The bristle design would require precise placement by the user to effectively cleanse the aforementioned three available tooth surfaces.

Caldwell preferred a smaller common handle, which allowed compaction of the two heads for storage. This is unecessarily costly and unsanitary. The two heads were designed to accomplish specific tasks in oral cleansing. The two bristle arrangements were partially confined inside the projected long axis of the handle and pointed in slightly divergent directions from the handle. The thin handle design would be wet and slippery in use.

Papas preferred a small, rounded common handle, with disadvantages cited above, but with the two heads pointed in opposing, parallel directions, perpendicular to the projected long axis of the handle. A main reason cited for the existence of two heads was limiting bacterial growth from overuse of one head. The bristle arrangements were identical and not designed for a specific area. There was an attempt to increase access with a flattened "s" curve shape to the handle and a bullet shape to the heads.

Warren et al. preferred a conventional handle and a single head with a specific bristle arrangement of hard and soft bristles. The design of the bristle arrangement was good in that it attempted to place specific bristles at specific areas on the tooth surfaces. It depended, however, on the knowledge of the user to correctly place the bristles in the correspondingly correct area. The use of hard bristles must have judicious use in the mouth, as they can abrade tooth structure and irritate gum tissues.

Heretofore, toothbrushes of conventional design and prior art cited above had restricted effectiveness due to dependence on the user's ability to correctly place the specific bristle arrangement, large head designs, small handle designs which will roll and slip in wet fingers, and hard bristles that abrade dental tissues.

OBJECTS

Design of my toothbrush will dictate precise placement of bristles for improved cleansing of teeth. My invention is designed to allow each bristle arrangement to clean one-half of the area on the aforementioned three available tooth surfaces, thus allowing increased specialization of each bristle arrangement to more effectively accomplish cleaning. This specialization of each bristle arrangement thus dictates the necessity of: (1) two bristle arrangements diametrically opposed, and, (2) a labeling method identifying the location of intended use in the mouth of the user.

Accordingly, an object of my invention is a large, smooth, generally square common handle with four labels, two on each end, and preferably near the neck portions. The labels identify the location of intended use of each bristle arrangement. This handle is more easily grasped in use. The labels are placed on a large, square surface for easy visualization. The smooth handle is more sanitary.

The object of the design of the two neck portions is to bring the bristle arrangements into maximum possible contact with tooth and gum surfaces concomitant with the least interference from cheek, tongue, coronoid process of the mandible, and teeth not being immediately cleansed. Unlike conventional toothbrushes, my neck portions bring the bristle arrangements completely outside of the projected long axis and direction of the handle by their curved sides. The space thus created prevents teeth, bone, and muscle interferences to proper bristle placement.

Accordingly, the object of neck end, or brushead design of my invention is to eliminate interference to bristle placement by angle of placement on the neck portions. The neckends are placed at opposite angles of approximately 45 degrees to the long axes of the handle and neck portions to automatically bring bristle arrangements, located on the neck ends, into the desired maximum effective working positions against the tooth and in contact with gumlines. This angular placement specifies the location of intended use, which the aforementioned labels will identify by placing the portions of the bristle arrangements intended for the gum line areas farther away from the axes of the neck portions, and thus the portions of the bristle arrangements intended for the biting surfaces closer to the axes of the neck portions. The situation naturally encountered in the mouth is that the gum line is the more difficult area to reach and the biting surfaces of teeth readily accessible. The user must, when using a conventional toothbrush, consciously think and make an effort to reach the gum line area. The user must angle the conventional brush to contact gumline areas. The angled neck ends of my invention automatically accomplish this. My invention would diminish gag reflex, as the angled placement of neck ends precludes the need for intimate contact with the back of the palate and the tongue in the effort to reach gum line areas.

The bristle arrangement can be more specific in its arrangement, resulting in greater effectiveness in plaque removal, if each bristle arrangement is intended for one-half of the total area of the aforementioned three available tooth surfaces. Accordingly, one edge or side of each bristle arrangement consists of a row of longer bristles arranged in varying lengths so as to form an overall shape of the gumline area. An intermediate area of each bristle arrangement is arranged of bristles in rows varied in lengths so as to conform intimately to the convex curves of either the tongue or cheek sides of teeth, dependent upon the half of the tooth surface being cleaned. The third portion of the bristle arrangements is a single row of bristles of equal lengths designed for each one-half of the biting surface, or top, of each tooth.

Further advantages and objects of my invention will become apparent from a consideration of the drawings and ensuing descriptions thereof.

DESCRIPTION OF DRAWINGS

FIG. 1 is a side view of my invention 8.

FIG. 2 is a view of my invention 8, rotated 90 degrees about axis 20 from the view seen in FIG. 1.

FIG. 3 is a view in detail of a cross section of the portion of the handle 10, indicated by section lines 3—3 in FIG. 1.

FIG. 4 is a view in detail of a cross section of the neck portion 22, indicated by section lines 4—4 in FIG. 1.

FIG. 5 is a view in detail of a cross section of the neck portion 22, indicated by section lines 5—5 in FIG. 1.

FIG. 6 is an end-on view of the neck end 44 and respective bristle arrangement 36 as seen in FIG. 1. The letter A will be used in FIGS. 13 through 18 to illustrate operation of the toothbrush 8.

FIG. 7 is an end-on view of the neck end 42 and respective bristle arrangement 34 as seen in FIG. 1. The letter B will be used in FIGS. 13 through 18 to illustrate operation of the toothbrush 8.

FIG. 8 is a side view of either sulcular portions 64 and 64$^1$, as seen in FIGS. 6 and 7.

FIG. 9 is an enlarged view of Label 50 as seen in FIG. 1.

FIG. 10 is an enlarged view of Label 50$^1$ as seen in FIG. 1.

FIG. 11 is an enlarged view of Label 52 as seen in FIG. 1.

FIG. 12 is an enlarged view of Label 52$^1$ as seen in FIG. 1.

FIG. 13 is a side view of an upper front tooth, such as an incisor or canine, and placement of bristle arrangements on the lingual surface thereof. The lettering indicates positions, relevant as to rotation or inversion of the toothbrush 8, of the bristle arrangements as seen in FIGS. 6 and 7.

FIG. 14 is a side view of a lower front tooth, such as an incisor or canine, and placement of bristle arrangements on the facial surface thereof. The lettering indicates positions, relevant as to rotation or inversion of the toothbrush 8, of the bristle arrangements as seen in FIGS. 6 and 7.

FIG. 15 is a rear view of an upper left back tooth, such as a bicuspid or molar, and placement of bristle arrangements on both sides thereof. The lettering indicates positions, relevant as to rotation or inversion of the toothbrush 8, of the bristle arrangements as seen in FIGS. 6 and 7.

FIG. 16 is a rear view of an upper right back tooth, such as a bicuspid or molar, and indicated placement of bristle arrangements on both sides thereof.

FIG. 17 is a rear view of a lower left back tooth, such as a bicuspid or molar, and indicated placement of bristle arrangements on both sides thereof.

FIG. 18 is a rear view of a lower right back tooth, such as a bicuspid or molar, and placement of bristle arrangements on both sides thereof. The lettering indicates positions, relevant as to rotation or inversion of the toothbrush 8, of the bristle arrangements as seen in FIGS. 6 and 7.

PREFERRED EMBODIMENTS

Referring to the drawings, wherein like numerals refer to like parts throughout the several views, FIG. 1 shows a toothbrush 8, elongated handle designated 10, and neck portions 22 and 24 secured at opposite ends thereto. The handle 10 preferably consists of an intermediate portion 18 having a longitudinal axis 20.

The two neck portions 22 and 24 preferably contain two and opposing curved sides 26 and 28 respectively, to accomodate and prevent hindrance from tongue and cheeks. The neck portions 22 and 24 preferably contain two and opposing straight sides, 30 and 32 respectively, upon which two bristle arrangements 34 and 36 are located, facing away from said curved sides 26 and 28 respectively. The neck portions 22 and 24 are preferably placed upon said handle 10 so as to form two angles $x^1$ and x, at opposite ends, with projected long axis 20. Angles $x^1$ and x are preferably of sufficient degree so as to bring bristle arrangements 34 and 36 respectively, completely outside of projected lines of interference of handle 10, such lines of potential interference as indicated 38 and 40 respectively, in FIG. 1.

Bristle arrangements 34 and 36 are placed on opposing neck ends 42 and 44 respectively, so as to be opposite to each other in projected direction. Neck ends 42 and 44, so as to contain and accomodate bristle arrangements 34 and 36 respectively, are increased in width to form preferably generally rectangular shapes. The thickness dimension of neck ends 42 and 44 should preferably be equal to, not greater than, thickness dimension of neck portions 22 and 24 at points 46 and 48 respectively.

In FIG. 1, four separate identifying labels 50, 50$^1$, 52, and 52$^1$ are preferably placed upon handle 10 at the junction of neck portions 22 and 24 with handle 10. The said four identifying labels describe locations of intended usage in the mouth for the bristle arrangements located upon the corresponding ends of toothbrush 8. Thus, identifying label 50 describes locations of intended usage of bristle arrangement 34, when bristle arrangement 34 is held toward the mouth as shown in FIG. 1, for use on lower teeth. Identifying label 50$^1$ describes locations of intended usage of bristle arrangement 34, when bristle arrangement 34 is held toward the mouth but inverted 180 degrees for use on upper teeth. Identifying label 52 describes locations of intended usage of bristle arrangement 36 when bristle arrangement 36 is held toward the mouth as shown in FIG. 1, for use on upper teeth. Identifying label 52$^1$ designates locations of intended usage of bristle arrangement 36, when bristle arrangement 36 is held toward the mouth but inverted 180 degrees for use on lower teeth.

FIG. 2 shows toothbrush 8 rotated 90 degrees relative to the view of FIG. 1. Identifying labels 50 and 52 are visible.

Neck ends 42 and 44, and hence, bristle arrangements 34 and 36 respectively, are preferably pitched around horizontal axis 20 so as to form opposite angles of 45 degrees to the perpendicular of long axis 20 of handle 10, and to the perpendicular of long axes of neck portions 22 and 24 respectively, said long axes of neck portions 22 and 24 being designated in FIG. 1 as z and z$^1$, respectively.

Referring to FIGS. 6 and 7 showing the neck ends 44 and 42, which contain surface 54 to which bristle tufts 56 are fastened in the conventional manner, said surface 54 being generally planar and includes or is molded to form holes 58, to secure tufts 56 of bristle arrangements 34 and 36. The bristle tufts 56 extend outwardly and perpendicular with respect to said surface 54.

FIGS. 6 and 7 show the bristle arrangements 34 and 36 respectively as seen from end views of each end of toothbrush 8, oriented as in FIG. 1. Each bristle arrangement is composed of three specific portions.

Occlusal portions 60 and 60$^1$ consist of a single row of bristle tufts extending the entire lengths of neck ends 42 and 44 respectively. Occlusal portions 60 and 60$^1$ are intended for use on the occlusal, or biting surfaces of teeth being cleansed. The bristle tufts of occlusal portions 60 and 60$^1$ are all equal in length.

The intermediate portions of bristle arrangements 34 and 36 are designated 62 and 62$^1$ respectively. Intermediate portions 62 and 62$^1$ consist of four rows of bristle bundles extending the entire lengths of neck ends 42 and 44 respectively. The rows immediately adjacent to the occlusal portions 60 and 60$^1$, previously described, are shorter in length than occlusal portions 60 and 60$^1$ so as to leave occlusal portions prominent. Progressing across the widths of neck ends 42 and 44, away from the occlusal portions 64 and 64$^1$, the remaining three rows are graduated in length until the third row of intermediate portions 62 and 62$^1$ is approximately equal in length to the aforementioned occlusal portions. The intermediate portions 62 and 62$^1$ thus generally form a uniformly curved depression. Each bristle tuft in the same row of intermediate portions 62 and 62$^1$ are equal in length to tufts in that row.

The sulcular portions 64 and 64$^1$ are intended for the gingival sulcus area (gum line). Sulcular portions 64 and 64$^1$ consist of a single row of bristle bundles which extend the lengths of neck ends 42 and 44 respectively. The bristle tufts which make up the sulcular portions are varied in length so that the entire row forms three points 65, 66 and 67 and two depressions 68 and 69 as seen in the side view of sulcular portions 64 or 64$^1$ in FIG. 8. The shortest bristle, i.e. at the bottom of each depression 68 and 69, is longer than any of the bristle lengths in the other two portions of the bristle arrangement.

All bristles previously described should preferably be of nylon and have a rounded end. The four identifying labels previously described should preferably be permanently bonded to the handle 10, with lettering of labels comprised of a nonsoluble, non-toxic material of a type in conventional usage where intimate contact with moisture and human tissues exists. The actual lettering preferably should not be recessed or raised into the label for maintaining legibility and prevention of contamination in use. Lettering preferably should be contrasted in color from the labels and be in block form for ease of reading. The material comprising the neck ends, neck portions, and common handle, all previously described, preferably should be identical and integrally molded to form one piece, as with conventional toothbrush handles, necks and brushheads. All edges and corners should be rounded and smooth.

OPERATION

The common handle 10 provides a large, generally square grasping surface for the hand of the user. A cross section of handle 10 is seen in FIG. 3. Identifying labels 50, 50$^1$, 52 and 52$^1$ are placed in the handle 10 near junctions of neck portions 22 and 24 as seen in FIG. 2. When the user observes each label when bristle arrangements are toward the mouth of the user, as is customary, the location of intended use for that particular bristle arrangement is automatically identified. The labels will properly identify the location of intended usage in the mouth of the user irrespective of whether the user uses the right or left hand, or if the bristle arrangements are pointing up or down. If the handle is rotated 180 degrees, the same bristle arrangement is ready for use in the opposing dental arch, which the label, now observable, will identify. Preferable labeling is shown in FIGS. 9, 10, 11, 12. When the user has used each bristle arrangement in all locations of usage, and in inverted positions, as identified by labels 50, 50$^1$, 52 and 52$^1$, the three accessible tooth surfaces of each tooth previously alluded to, will have been cleansed.

Neck portions 22 and 24 serve to extend the neck ends 42 and 44 respectively, with their respective specialized bristle arrangements 34 and 36, to the mouth of the user and into maximum possible contact with tooth and gum surfaces. The curved sides 26 and 28 bring the neck ends and their respective bristle arrangements completely out of the projected long axis 20 of handle 10. In doing so, neck portions eliminate potential interference from cheek musculature, tongue, coronoid process of the mandible, and other teeth not immediately being cleansed. Cross sections of neck portions are seen in FIGS. 4 and 5.

Neck ends 42 and 44 are to contain and support bristle arrangements 34 and 36 respectively. The neck ends serve also to place their corresponding bristle arrangements at an angle of approximately 45 degrees to projected long axes as designated in FIG. 1 as z and $z^1$, respectively, and hence also to Axis 20. This angled placement brings bristle arrangements into the maximum desired working position against the tooth and gum surfaces. This angle of placement can be seen in FIGS. 6 and 7 as angles y and $y^1$.

Bristle arrangements 34 and 36 are specialized, as previously described in the section of Preferred Embodiments. Because bristle stiffness is inversely proportional to bristle length, the sulcular portions are the most flexible of the three portions previously described. Flexibility is imperative in the sulcular portion due to its intended contact with the soft tissues of the gumline area. Rounded end, flexible bristles will not abrade gum tissue. Longer, flexible bristles will bend more easily into the recesses and underneath the gum line.

The increased specialization of the bristle arrangements dictates the necessity of a double-headed brush, with each bristle arrangement being opposite in direction from the other. Using a gentle, shaking motion, the three portions previously described will reach and cover their respective intended working areas of approximately one-half of the available area of each tooth. Labeling is required to orient the intended location of usage in the mouth of the user.

FIGS. 6 and 7 show end views of neck ends 44 and 42 respectively, as would be seen if viewed with toothbrush 8 in the position in FIG. 1. These neck ends, with their respective bristle arrangements 36 and 34, are designated as "A" and "B" to further illustrate operation on the surfaces of human teeth, as found in FIGS. 13 through 18.

FIG. 13 shows placement on the lingual surface of an upper front tooth, such as an incisor or canine. The designation, "A", indicates the correct position in this area of the mouth of the user if the end shown in FIG. 6 is used. The designation "(B)", indicates the correct position in this area of the mouth of the user if the end shown in FIG. 7 is used, but of necessity inverted 180 degrees.

FIG. 14 shows placement on the facial surface of a lower front tooth, such as an incisor or canine. The designation, "(A)", indicates correct position of the end view shown in FIG. 6, of necessity inverted 180 degrees. The designation, "B", indicates correct position in this area of the mouth of the user if the end shown in FIG. 7 is used.

FIGS. 15 through 18 are shown as viewed from the inside of the mouth of the user, looking out.

FIG. 15 shows use of the brush on an upper left bicuspid or molar tooth, with "(B)" on the cheek side and "A" on the tongue side. FIG. 16 shows use of the brush on an upper right bicuspid or molar tooth, with "(B)" on the tongue side and "A" on the cheek side.

FIG. 17 shows use of the brush on a lower left bicuspid or molar tooth, with "(A)" on the cheek side and "B" on the tongue side. FIG. 18 shows a lower right bicuspid or molar tooth with "(A)" on the tongue side and "B" on the cheek side.

The FIGS. 6, 7 and 13 through 18 illustrate operation of the toothbrush 8, as all three available surfaces, as alluded to before, are reached and contacted by the specialized bristle arrangements 34 and 36.

While the above description contains many specificities, these serve to illustrate a concept and should not be construed as limitations on the scope of the invention, but rather as an exemplification of one preferred embodiment thereof. Other variations are possible, such as color coding the neck portions to make habit formation possible and easing the use of a more complicated toothbrush. The large, square handle could conceivably accomodate a compartment for a replaceable floss spool, with an exit to retrieve the floss and cut off the desired length. Accordingly, the scope of the invention should be determined not by the embodiment illustrated, but by the appended claims and their legal equivalents.

I claim:

1. A toothbrush comprising:

an enlongated generally square handle with an intermediate portion having a longitudinal axis, and, said handle containing four labels clearly indicating locations of intended usage, said four labels being prominently displayed and being located at or near ends of said handle, with two of said labels being at each end of said handle, and two labels at each end of said handle being located on opposite sides thereof, and, a pair of neck portions respectively secured to opposite ends of said handle, said neck portions extending in substantially parallel planes but with curved sides bringing ends of said neck portions most remote from said handle completely out of and at opposite angles to said longitudinal axis, and a pair of neck ends respectively secured to opposite ends of said handle by means of said neck portions, said neck ends extending in nonparallel planes by virtue of placement on said neck portions at opposite angles of approximately 45 degrees to and rotated around said longitudinal axis, and, said neck ends having bristle tufts secured thereto so as to form bristle arrangements that extend perpendicularly from said neck ends, with said neck ends oriented so said bristle arrangements generally oppose each other in direction, and said bristle arrangements each consisting of three component portions of bristle tufts, said three portions of bristle tufts generally arranged in rows and extending the entire lengths of said neck ends, said three portions of bristle tufts generally perpendicular to said neck ends, said bristle arrangements being diametrically opposed to each other in arrangement on said neck ends, whereby said bristle arrangements can be more specialized and improved in the effective removal of plaque from user's teeth and gumline.

2. The toothbrush as specified in claim 1, wherein each said bristle arrangement, with said three component portions of bristle tufts, is arranged so as to more closely cover, contact, and conform to three specific areas of each tooth while cleaning, said three specific areas of each tooth being:

a. approximately one half of the biting surface, tongue or cheek side, b. either side nearest tongue or cheek/lip, and c. gumline, whereby said bristle arrangements can be more specialized and improved in the effective removal of plaque from user's teeth and gumline.

3. The toothbrush as specified in claim 1, wherein said two bristle arrangements are arranged as diametrically opposite and affixed to opposing ends of said toothbrush as the means by which the total available area of each tooth being cleansed is covered by said toothbrush, whereby said bristle arrangements can be more specialized and improved in the effective removal of plaque from user's teeth and gumline.

* * * * *